US006179958B1

(12) United States Patent
Lysén et al.

(10) Patent No.: US 6,179,958 B1
(45) **Date of Patent: *Jan. 30, 2001**

(54) METHOD FOR CONTINUOUS COOKING OF CELLULOSE-CONTAINING FIBRE MATERIAL

(75) Inventors: Claes Göran Lysén; Torbjörn Ulf Olsson, both of Karlstad (SE); Gunnar Carl Wernqvist, Biot (FR)

(73) Assignee: Kvaerner Pulping AB (SE)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/117,593

(22) PCT Filed: Feb. 7, 1997

(86) PCT No.: PCT/SE97/00183

§ 371 Date: Jul. 29, 1998

§ 102(e) Date: Jul. 29, 1998

(87) PCT Pub. No.: WO97/29236

PCT Pub. Date: Aug. 14, 1997

(30) Foreign Application Priority Data

Feb. 9, 1996 (SE) ..... 9600472

(51) Int. Cl.[7] ..... D21C 3/26

(52) U.S. Cl. ..... 162/17; 162/15; 162/16; 162/17; 162/19; 162/47

(58) Field of Search ..... 162/15, 16, 17, 162/19, 47

(56) References Cited

U.S. PATENT DOCUMENTS

| | | | | |
|---|---|---|---|---|
| 3,298,899 | | 1/1967 | Laakso . | |
| 4,608,121 | | 8/1986 | Ostman . | |
| 5,080,755 | | 1/1992 | Backlund . | |
| 5,256,255 | * | 10/1993 | Fagerlund | 162/237 |
| 5,302,247 | * | 4/1994 | Richardsen et al. | 162/42 |

FOREIGN PATENT DOCUMENTS

| | | |
|---|---|---|
| 1 210 907 | 9/1986 | (CA) . |
| 0 476 230 A2 | 3/1992 | (EP) . |
| 0 477 059 B1 | 3/1992 | (EP) . |
| 175156 | 4/1961 | (SE) . |
| 420511 | 10/1981 | (SE) . |
| WO 9607787 A1 | 3/1996 | (WO) . |

* cited by examiner

*Primary Examiner*—Stanley S. Silverman
*Assistant Examiner*—Mark Halpern
(74) *Attorney, Agent, or Firm*—Fasth Law Offices; Rolf Fasth

(57) ABSTRACT

A method for cooking chips, involving steaming the chips, impregnating the chips with impregnating liquid in an impregnation vessel, which impregnating liquid comprises fresh cooking liquid and spent liquor, extracting spent liquor from the impregnation vessel, cooking the impregnated chips in cooking zones including an introductory co-current cooking zone and a concluding counter-current cooking zone, extracting spent liquor from the digester at a position between the said co-current and counter-current cooking zones, transferring the said spent liquor from the digester to at least one position upstream of the digester, circulating the cooking liquid in a bottom circulation within the said counter-current cooking zone, heating the circulating cooking liquid by means of heat exchange, and supplying wash liquid to the bottom of the digester. According to the invention, at least some of the digester extract, before being transferred to the said position upstream of the digester, undergoes heat exchange with at least some of the cooking liquid in the said bottom circulation.

12 Claims, 3 Drawing Sheets

METHOD FOR CONTINUOUS COOKING OF CELLULOSE-CONTAINING FIBRE MATERIAL

The present invention relates to a method for continuous cooking of cellulose-containing fibre material, the said method involving steaming the fibre material, impregnating the fibre material with impregnating liquid in an impregnation vessel, which impregnating liquid comprises fresh cooking liquid and spent liquor, extracting spent liquor from the impregnation vessel, cooking the impregnated fibre material in a digester at a predetermined cooking temperature in a plurality of cooking zones including an introductory co-current cooking zone and a concluding counter-current cooking zone, extracting spent liquor from the digester at a position between the said co-current and counter-current cooking zones, transferring at least the greater part of the said spent liquor from the digester to at least one position upstream of the digester, circulating the cooking liquid in a bottom circulation within the said counter-current cooking zone, heating the circulating cooking liquid by means of at least one heat exchange, and supplying wash liquid to the bottom of the digester.

In a cooking process, large amounts of energy are consumed in the form of steam. Of the many measures which are taken in order to achieve more economic operation, an important one is that of reducing the energy consumption.

The object of the present invention is to minimize the energy supplied from external sources under the specified process conditions.

The method according to the invention is characterized in that at least some of the said greater part of the digester extract, before being transferred to the said position upstream of the digester, undergoes heat exchange with at least some of the cooking liquid in the said bottom circulation.

The cooking temperature in the cooking zones of the digester is typically around 160° C., and the spent liquor extracted from the digester is therefore at this cooking temperature. According to the present invention, the energy which is released when the temperature is lowered to typically around 90° C. is utilized in such a way that it can be recirculated into the process, without cooling, for the purpose of generating warm water, since each joule of energy expended in this way requires a corresponding joule of energy supplied on the steam side.

The invention will be explained in greater detail hereinbelow with reference to the attached drawings.

Figure 1:
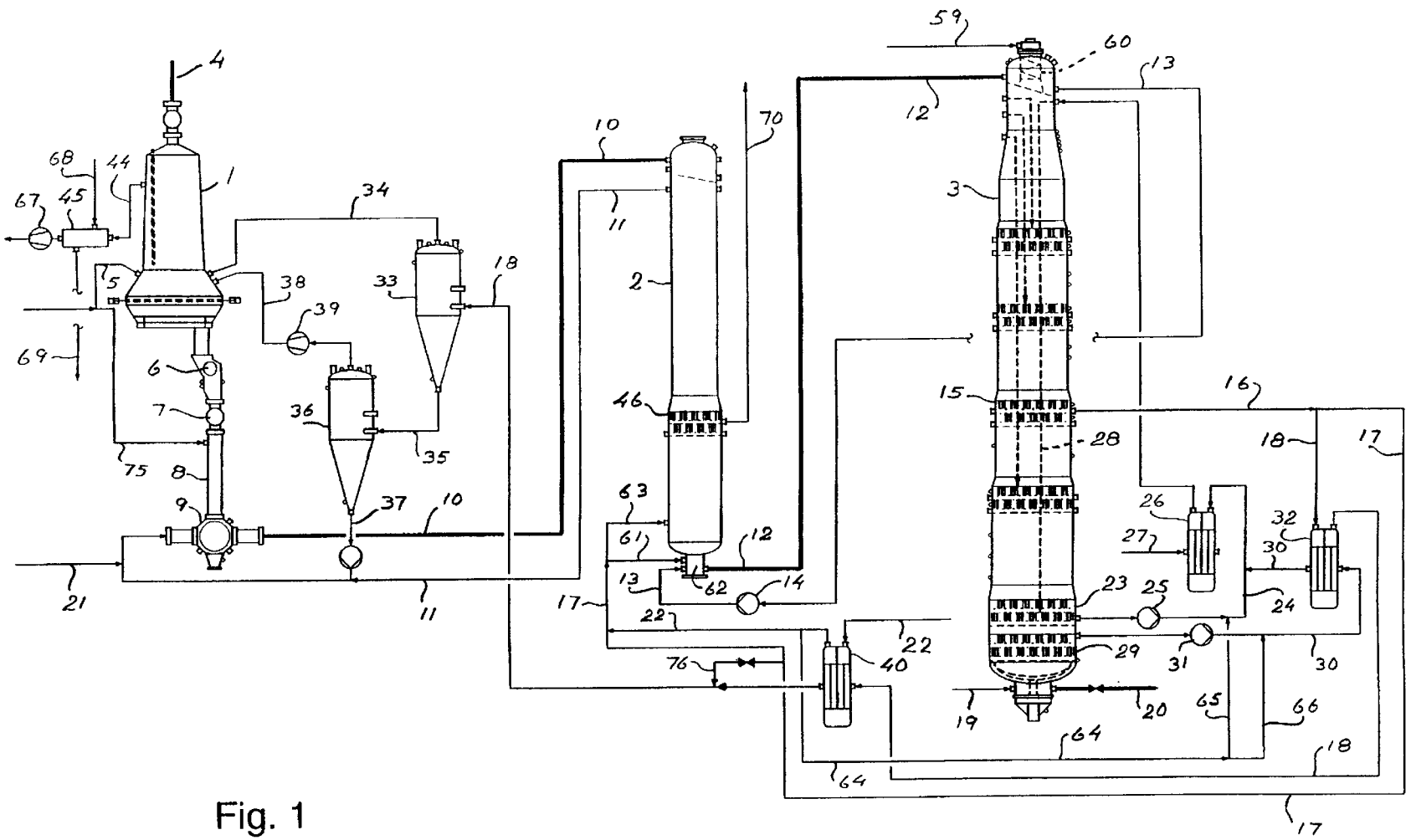
Figure 2:
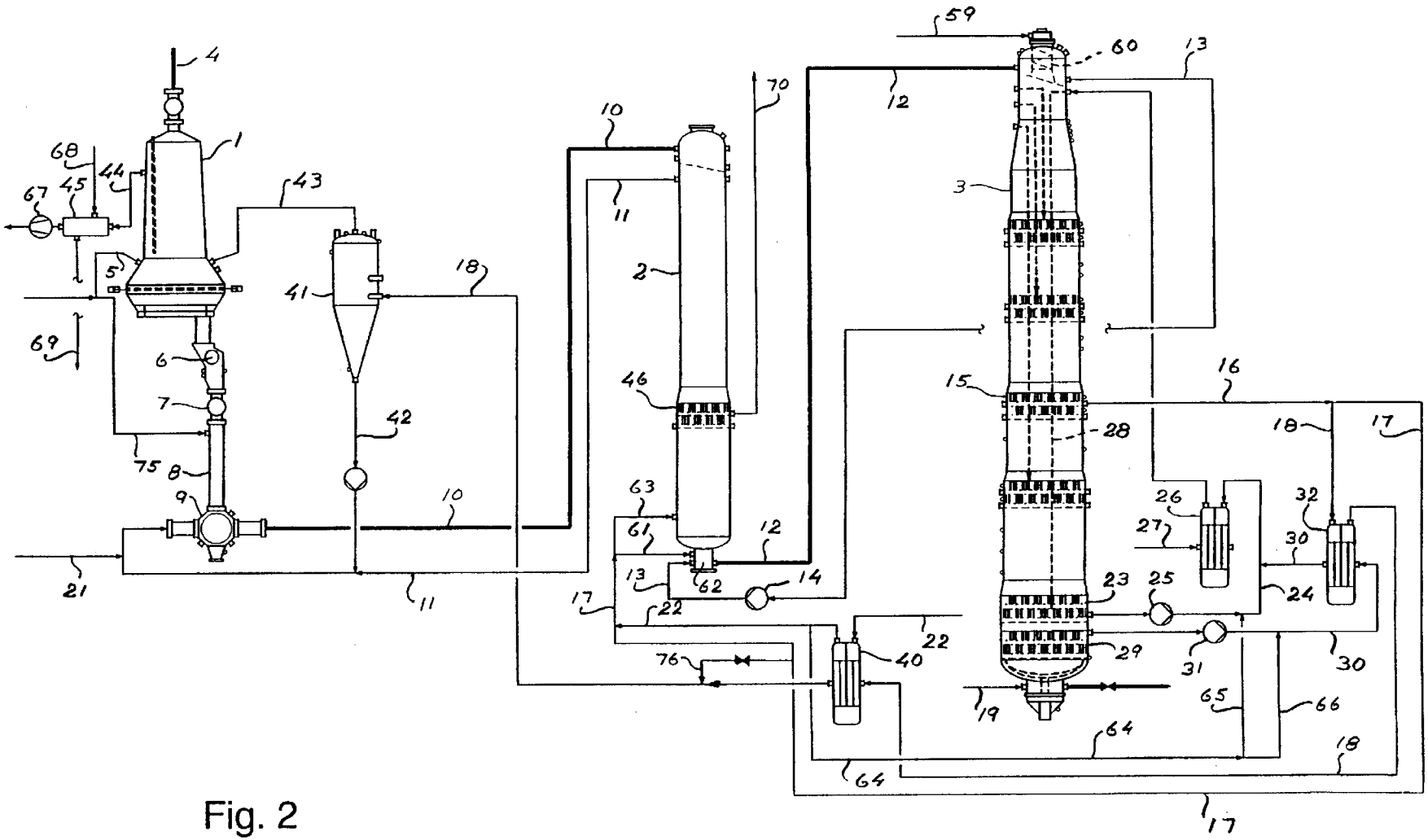
Figure 3:
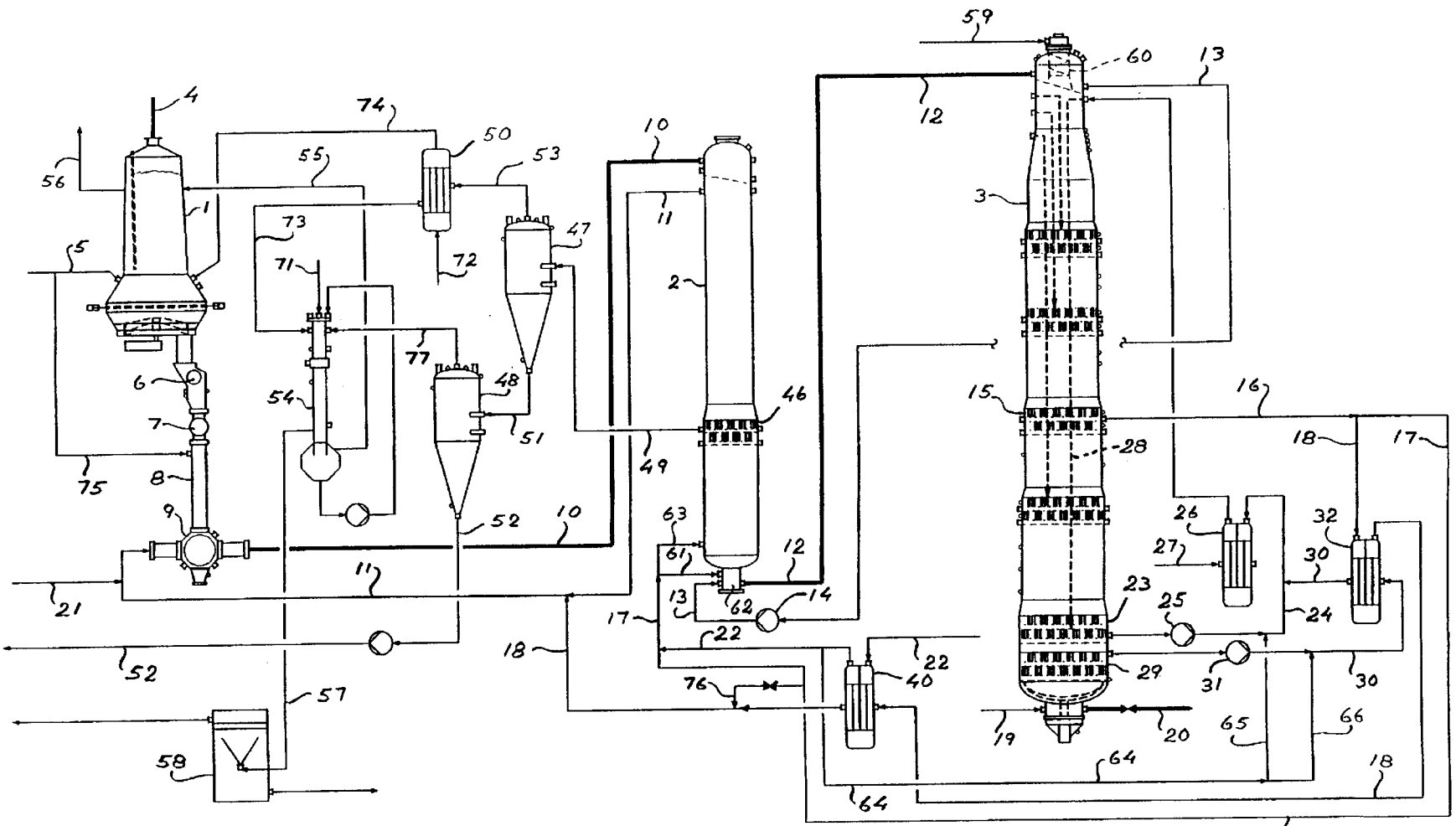

FIGS. 1 to 3 are schematic representations of different installations for carrying out a cooking process according to the invention.

The installation shown schematically in FIG. 1 and used for cooking cellulose-containing fibre material, for example chips, comprises a chip bin 1, a vertical impregnation vessel 2 and a vertical digester 3. The chips are fed into the chip bin 1, which also functions as steaming vessel, via a line 4, and low-pressure steam is supplied through a line 5 for the purpose of heating the chips and reducing their air content. From the chip bin 1, which is at atmospheric pressure, the chips drop into a chip chute 8 via a chip meter 6 and low-pressure feeder 7. A high-pressure feeder 9 is mounted at the lower end of the chip chute 8. Low-pressure steam is also supplied to the chip chute 8 via a line 75.

Between the chip bin 1 and the impregnation vessel 2 there is a top circulation, which comprises a feed line 10 and a return line 11. The high-pressure feeder 9 is provided with a rotor with pockets, one pocket always being in the low-pressure position so as to be in open communication with the chip chute 8, and another pocket at the same time always being in the high-pressure position so as to be in open communication with the impregnation vessel 2 via the said feed line 10, which is connected to the top of the impregnation vessel 2. The said return line 11, which is provided with a pump (not shown), extends from the upper part of the impregnation vessel 2 to the high-pressure feeder 9 for return of impregnating liquid which is separated off by a top separator (not shown) arranged in the impregnation vessel 2. When a filled rotor pocket comes into the high-pressure position, i.e. in direct communication with the top circulation, it is flushed clean by the return liquid from the return line 11, and the suspension of chips and impregnating liquid is fed into the top of the impregnation vessel 2 via the feed line 10.

The impregnation vessel 2 has an extraction screen 46 for extracting spent liquor, which is sent to evaporation via a line 70.

Between the impregnation vessel 2 and the digester 3 there is a transfer circulation, which comprises a feed line 12 and a return line 13. The feed line 12 extends from the bottom of the impregnation vessel 2 to the top of the digester 3, where a screen 60 is arranged for separating a certain amount of cooking liquid, which is circulated back to the bottom of the impregnation vessel 2 via the return line 13, which is provided with a pump 14. Medium-pressure steam is supplied to the top of the digester 3 via a line 59.

In its central portion the digester 3 has an extraction screen 15 for extracting spent liquor, for example black liquor, via a line 16, which branches into a first branch line 17 and a second branch line 18 for dividing the black liquor into first and second streams which can be identical or essentially identical in size. The first branch line 17 is connected to the lower end portion of the impregnation vessel 2, and it has a line section 61, which connects to the outlet 62, and a line section 63 which connects to the impregnation vessel 2 at a position slightly above the outlet 62. The second branch line 18 is connected indirectly to the impregnation vessel 2 via an expansion system and the said top circulation.

Warm wash liquid is supplied to the bottom of the digester 3 via a line 19. The wash liquid is at a temperature which is normally below 100° C. and generally lies between 70° C. and 90° C. The delignified chips are discharged through a line 20 for continued processing.

Co-current conditions prevail above the extraction screen 15 of the digester, whereas counter-current conditions prevail below the extraction screen 15, starting from the level for supply of the wash liquid via the line 19 and upwards.

Fresh cooking liquid, i.e. white liquor, is charged at various points in the process, namely to the top circulation 10, 11 via a line 21, and to the transfer circulation 12, 13 via a line 22, and also to the digester circulations, for example via a line 64.

The digester has a bottom circulation, which comprises a first screen 23, a main line 24, a pump 25 for feeding circulation liquid through the main line 24 and a heat exchanger 26 which is fed with steam via a line 27 in order to raise the circulation liquid passing through the heat exchanger 26 to cooking temperature. The main line 24 comprises a central pipe 28 which extends downwards through the digester 3 and has its mouth situated adjacent to the first screen 23.

The bottom circulation additionally comprises a second screen 29 and a line 30 which extends from the second screen 29 to the main line 24, to which it joins at a position situated upstream of the heat exchanger 26 of the main line 24. A pump 31 is arranged in the line 30 for feeding circulation liquid from the second screen 29 to the main line 24. The second screen 29 is arranged under the first screen 23, and the distance between the screens 23, 29 is expediently the shortest possible, as is shown in FIG. 1.

A heat exchanger 32 is furthermore arranged in the line 30 in order to raise the temperature of the liquid which is extracted from the second screen 29 and which is circulating through the line 30. For this purpose, the said second branch line 18 for black liquor is connected to the last-mentioned heat exchanger 32 in order to transfer some of its heat content to the liquid circulating through the line 30. The second branch line 18 is then connected to a further heat exchanger 40, to which the said line 22 for white liquor is connected in order to raise the temperature of the white liquor. Such heated white liquor can be supplied to the lines 24, 30 of the bottom circulation upstream of their heat exchangers 26, 32 via the line 64 and the line sections 65, 66 thereof. After the black liquor has passed the heat exchanger 40, the temperature of the said black liquor in the branch line 18 can be raised with a suitable quantity of black liquor from the first branch line 17 via a line 76 provided with a valve.

The second branch line 18 is connected to an expansion system which, in the embodiment shown in FIG. 1, comprises a first flash cyclone 33, which is connected via a line 34 to the chip bin 1 for supply of the flash steam which is released in the flash cyclone 33, and is connected via a line 35 to a second flash cyclone 36, which in turn is connected via a line 37 to the return line 11 and via a line 38 to the bottom of the chip bin 1 for supply of the flash steam which is released in the second flash cyclone 36. In the first flash cyclone 33, the black liquor is expanded to slightly below atmospheric pressure, while expansion takes place in the second flash cyclone 36 at a subatmospheric pressure which is lower than in the first flash cyclone 33, and a thermocompressor 39 is arranged in the steam line 38 in order to increase the pressure of the steam to essentially the same pressure as in the first flash cyclone 33. Steam containing turpentine is led off from the chip bin 1 via a line 44, which is connected to a condenser 45 and a fan 67. Cool water is supplied to the condenser 45 via a line 68, and the turpentine thus condensed is led off via a line 69.

In the embodiment shown in FIG. 2, the second branch line 18 is connected to an expansion system, which comprises only one flash cyclone 41, which is connected via a line 43 to the chip bin 1 for supply of the flash steam which is released in the flash cyclone 41, and is connected to the return line 11 via a line 42. The pressure in the chip bin 1 is in this case slightly lower than in the chip bin according to FIG. 1.

In the embodiment shown in FIG. 3, used for handling the second stream of black liquor from the digester extract, the branch line 18 for this second stream of black liquor is coupled directly to the return line 11 of the top circulation. A desired increase in temperature is obtained in this way in the top of the impregnation vessel. A black liquor with a high heat content, which is to be used for heating the chips at the feed position, is extracted from the extraction screen 46 of the impregnation vessel. The expansion system in this case comprises first and second flash cyclones 47, 48 connected in series, the extraction screen 46 being connected to the first flash cyclone 47 via a line 49. Expanded black liquor from the first flash cyclone 47 is conveyed via a line 51 to the second flash cyclone 48, and from the latter via a line 52 to evaporation. Flash steam from the first flash cyclone 47 is conveyed via a line 53 to a refluxboiler 50, while flash steam from the second flash cyclone 48 is conveyed to a refluxboiler 54, in which a mixture of air and steam in predetermined proportions is created, with air and water being supplied from above via a line 71. The first-mentioned refluxboiler 50 is supplied with hot water via a line 72, and condensate formed is led off to the said refluxboiler 54 via a line 73. Steam is led from the refluxboiler 50 to the chip bin 1 via a line 74. Flash steam from the second flash cyclone 48 is led to the refluxboiler 54 via a line 77. In this refluxboiler 54, water is evaporated at a temperature substantially below 100° C., while the pressure is kept at atmospheric pressure or slightly below atmospheric pressure by virtue of the inclusion of air. The mixture of air and steam which is formed in the refluxboiler 54 is led via a line 55 to the upper portion of the chip bin I so as to form therein a zone with a mixture of air and steam at atmospheric pressure, a line 56 being connected to the opposite side of the chip bin 1 within the said zone in order to lead air off to the atmosphere. The mixture of air and steam streams through the chip bin 1, while giving off steam to the chips. A turpentine-containing liquid is removed from the refluxboiler 54 and is transferred via a line 57 to an apparatus 58 for recovering turpentine.

The following examples specify important process conditions for the installations which have been described.

Moist chips at a temperature of 0° C. are fed into the chip bin 1 in a quantity of 4,280 kg/ADt, the water content being 50%. The chips are supplied with 311 kg of steam/ADt via the lines 5, 75, which corresponds to an energy supply of 851 MJ/ADt.

In order to set up the desired cooking temperature—160° C.—in the introductory co-current zone, medium-pressure steam is supplied via the line 59 in a quantity of 4 kg/ADt, corresponding to an energy supply of 12 MJ/ADt.

The spent liquor in the form of black liquor which is extracted by means of the extraction screen 15 is therefore at a temperature of 160° C., and its heat content will be utilized, down to 90° C., in such a way that the energy can be returned to the process without such cooling that generates warm water. According to this example, the amount of black liquor which is extracted from the digester 3 is about 11 tonnes per tonne of pulp, and this extract is divided up into two streams of approximately identical size, namely a first stream of 5.201 tonnes per tonne of pulp, and a second stream of 5.865 tonnes per tonne of pulp. The first stream, 5.201 tonnes per tonne of pulp, is led via the branch line 17 to the bottom of the impregnation vessel 2 via the line section 61 to the outlet 62 and via the line section 63, the black liquor in the latter case being conveyed in countercurrent to the extraction screen 46. The chips which have been transferred to the top of the digester thus come to have a temperature which is very close to the cooking temperature, and only very small quantities of steam in the form of medium-pressure steam need to be added at the top of the digester 3 via the line 59. The temperature of the transferred chips is 144° C. in this example, and the said quantity of steam is 4 kg/ADt, as has been indicated above.

In the bottom circulation, a total of about 8 tonnes of liquid per tonne of pulp is circulated in the main line 24 into the digester, with flows of identical size being removed via the upper screen 23 and the lower screen 29. The cooking liquid removed through the upper screen 23 is at a temperature of 153° C., while the cooking liquid removed through the lower screen 29 is at a temperature of 125° C. The last-mentioned cooking liquid is raised to a temperature of 157° C., when it undergoes heat exchange with black liquor in the heat exchanger 32. The two separately removed cooking liquids then undergo heat exchange with medium-pressure steam (190° C.) in the heat exchanger 26 to reach cooking temperature, i.e. 160° C. For this purpose, medium-pressure steam is supplied in a quantity of 86 kg/ADt, which corresponds to an energy supply of 238 MJ/ADt. The wash water which is supplied at the bottom of the digester via the line 19 is at a temperature of 90° C. The second stream of black liquor which passes the heat exchanger 32 gives of heat, so that its temperature drops to 130° C. This black liquor then undergoes heat exchange with white liquor in the heat exchanger 40, so that the temperature of the white liquor is raised from 90° C. to 127° C., while the outgoing black liquor acquires a temperature of 112° C.

In the embodiment according to FIG. 1, the second stream of black liquor is fed at a temperature of 112° C. to the first flash cyclone 33 in order to expand to a slightly subatmospheric pressure (78 kPa), and then to the second flash cyclone 36 in order to expand to a still lower subatmospheric pressure (55 kPa), after which the black liquor, whose temperature has first been lowered to 94° C. and finally to 85° C., is introduced into the top circulation 11, 10. The quantities of flash steam transferred to the chip bin 1 are at temperatures of about 94° C. and about 85° C., respectively. Low-pressure steam (140° C.) is introduced into the chip bin in order to raise the temperature of the chips to saturation temperature. The black liquor which is extracted through the extraction screen 46, and which is at a temperature of 89° C., is transferred to an evaporation installation. In this example, steam is thus supplied from outside in a total amount of 401 kg/ADt, which corresponds to an energy supply of 1.101 MJ/ADt, divided as follows: 851 MJ/ADt to the chip bin 1 and chip chute 8, 12 MJ/ADt to the top of the digester 3, and 238 MJ/ADt to the heat exchanger 26 of the bottom circulation.

In the embodiment according to FIG. 2, the second stream of black liquor is fed at a temperature of 112° C. to the one flash cyclone 41 in order to expand to a subatmospheric pressure, and then to the top circulation at a temperature of 91° C. The flash steam which is formed, and which is at a temperature of about 91° C., is transferred for steaming, which is done at a pressure of about 69 kPa. The black liquor which is extracted from the impregnation vessel, and which is at a temperature of 89° C., is transferred to the evaporation installation. In this example, steam is supplied from outside in a total quantity of 373 kg/ADt, which corresponds to an energy supply of 975 MJ/ADt, divided as follows: 697 MJ/ADt to the chip bin 1 and chip chute 8, 88 MJ/ADt to the top of the digester 3, and 190 MJ/ADt to the heat exchanger 26 of the bottom circulation.

In the embodiment according to FIG. 3, the second stream of black liquor is fed at a temperature of 122° C. to the return line 11 of the top circulation. The temperature in the top of the impregnation zone is 110° C. and rises, through heat of reaction, to 119° C. A black liquor with a temperature of 119° C. is extracted through the extraction screen 46 and passes the flash cyclones 47, 48 before being transferred to an evaporation installation at a temperature of 91° C. The two flash steams obtained have temperatures of about 111° C. and about 90° C., respectively. The flash steam from the first flash cyclone 47 is led to the refluxboiler 50, where it condenses at 111° C. and generates new steam having a temperature of 107° C., which is led to the lower portion of the chip bin 1, while the flash steam from the second flash cyclone 48 is led at a temperature of 90° C. to the refluxboiler 54 in order to generate steam there, which steam is mixed with air in order to obtain a mixture having a temperature of 84° C., the mixture comprising approximately equal parts of air and steam at atmospheric pressure (partial pressure of steam is 0.5 at 82° C.). The air/steam mixture streams through the chip bin 1 in an upper or introductory zone, the air then streaming out through the line 56 at a temperature of about 20° C. Almost all the steam condenses in the chips fed in. In this way, heat of 84° C. is transferred indirectly from the black liquor to the chips via the flash steam and the air/steam mixture, with the need to use either a vacuum or a compressor. In this example, steam from outside is supplied in a total quantity of 355 kg/ADt, which corresponds to an energy supply of 981 MJ/ADt, divided as follows: 220 MJ/ADt to the chip bin 1 and the chip chute 8, 494 MJ/ADt to the top of the digester 3, and 267 MJ/ADt to the heat exchanger 26 of the bottom circulation.

The heat balances which have been indicated for the installations described show that it is possible to reduce the heat energy supplied from outside in the form of primary steam from 2.3 GJ/ADt, in accordance with a conventional procedure, to 0.97 GJ/ADt in accordance with the method proposed by the invention, i.e. a decrease by more than half.

The method according to the invention can be carried out at cooking temperatures which lie within the range of 145° C. to 170° C. The temperature of the spent liquor, after it has been lowered in the described manner in order to utilize its heat content, can lie within the range of 80° to 100° C. The quantity of black liquor which is extracted from the digester can amount to 9–12 tonnes per tonne of pulp.

While the present invention has been described in accordance with preferred compositions and embodiments, it is to be understood that certain substitutions and alterations may be made thereto without departing from the spirit and scope of the following claims.

What is claimed is:

1. A method for continuous cooking of cellulose-containing fiber material, comprising:

providing a bottom circulation having a cooking liquid conduit connected thereto for carrying a cooking liquid therein;

steaming a fiber material;

impregnating the fiber material with an impregnating liquid in an impregnation vessel, the impregnation vessel containing a fresh cooking liquid and a first spent liquor extracting the first spent liquor from the impregnation vessel;

looking the impregnated fiber material in a digester at a predetermined cooking temperature in the digester, the digester having a concurrent cooking zone and a counter-current cooking zone;

extracting a first portion of a spent liquor from the digester at a position that is disposed between the concurrent cooking zone and the counter-current cooking zone;

extracting a second portion from the first portion of the spent liquor and transferring a remaining third portion of the spent liquor to the impregnation vessel;

passing the second portion of the spent liquor through a first heat exchanger;

supplying the cooking liquid from the cooking liquid conduit to the bottom circulation;

circulating the cooking liquid in the bottom circulation in operative engagement with the digester and the first heat exchanger;

transferring heat from the second portion of the spent liquor to the cooking liquid in the bottom circulation at the first heat exchanger and increasing a temperature of the cooking liquid in the bottom circulation to a cooking temperature; and supplying a wash liquid to a bottom portion of the digester the bottom portion being separate from the bottom circulation.

2. The method according to claim 1 wherein the method comprises dividing the first portion of the spent liquor into the second portion of spent liquor and the third portion of spent liquor, conducting the third portion to a position that is upstream of the digester and transferring heat from the second portion to the cooking liquid that is circulated in the bottom circulation and transferring the second portion of spent liquor to a position that is upstream of a screen disposed in the impregnation vessel.

3. The method according to claim 1 wherein the method comprises extracting a first amount of cooking liquid from a first screen disposed in the digester and circulating the first amount of the cooking liquid through a main line of the bottom circulation that is in operative engagement with the first screen, conducting the first amount of the cooking liquid through a central pipe of the bottom circulation that is in operative engagement with the main line, extracting a second amount of cooking liquid from a second screen disposed below the first screen, conveying the second amount via a second line to the first heat exchanger and transferring heat from a second portion of spent liquor to the second amount of cooking liquor.

4. The method according to claim 3 wherein the method comprises transferring heat from the second portion of the spent liquor to the second amount of cooking liquid in the first heat exchanger, conducting the first amount and the second amount of cooking liquid into the main line, conducting steam into a second heat exchanger and transferring heat from the steam to the first and the second amounts of cooking liquid in the second heat exchanger.

5. The method according to claim 3 wherein the method comprises transferring heat from the second portion of the spent liquor to the second amount of cooking liquid, providing a first fresh cooking liquid to a third heat exchanger, conducting the second portion of the spent liquor to the third heat exchanger and transferring heat from the second portion to the first fresh cooking liquid.

6. The method according to claim 1 wherein the method comprises providing a first fresh cooking liquid to a third heat exchanger, conducting the second portion of the spent liquor to the third heat exchanger and transferring heat from the second portion of the spent liquor to the first fresh cooking liquid and merging a portion of the first stream with the second stream.

7. The method according to claim 1 wherein the method further comprises providing a second fresh cooking liquid to the bottom circulation.

8. The method according to claim 3 wherein the method comprises conducting the second portion to a first flash cyclone and expanding the second portion to a pressure that is slightly under an atmospheric pressure, conducting the second portion to a second flash cyclone and expanding the second portion to a pressure that is a sub-atmospheric pressure that is lower than the atmospheric pressure and conducting the second portion to a top of the impregnation vessel and exposing the fiber material to a steam generated by the first and second flash cyclones.

9. The method according to claim 8 wherein the method further comprises conducting the second stream to a flash cyclone and expanding the second stream to a pressure that is slightly under an atmospheric pressure and conducting the second stream to a top portion of the impregnation vessel and exposing the fiber material to a steam generated by the flash cyclone.

10. The method according to claim 8 wherein the method comprises conducting the second portion to a top portion of the impregnation vessel, expanding the extracted spent liquor in a second and a third flash cyclone and evaporating the spent liquor, conducting a steam generated by the second flash cyclone to steam the fiber material, conducting a steam generated by the third flash cyclone to a refluxboiler, producing can air/steam mixture in the refluxboiler and conducting the air/steam mixture to an initial zone disposed in a chip bin.

11. The method according to claim 10 wherein the method comprises removing a turpentine-containing liquid from the refluxboiler, transferring the turpentine-containing liquid to an apparatus and extracting a turpentine from the turpentine-containing liquid.

12. A method for continuous cooking of cellulose-containing fiber material, comprising:

providing a bottom circulation having a cooking liquid conduit connected thereto for carrying a cooking liquid therein;

steaming a fiber material;

impregnating the fiber material with an impregnating liquid in an impregnation vessel, the impregnation vessel comprising a fresh cooking liquid and a spent liquor;

extracting the spent liquor from the impregnation vessel;

expanding the extracted spent liquor in a first and a second flash cyclone and evaporating the spent liquor;

conducting a steam generated by the first flash cyclone to steam the fiber material;

conducting a steam generated by the second flash cyclone to a refluxboiler;

producing an air/steam mixture in the refluxboiler;

conducting the air/steam mixture to an initial zone disposed in a chip bin; and cooking the impregnated fiber material in a digester;

supplying the cooking liquid from the cooking liquid conduit to the bottom circulation;

circulating the cooking liquid in the bottom circulation in operative engagement with the digester; and transferring heat from a spent liquor withdrawn from the digester to the cooking liquid in the bottom circulation at a first heat exchanger and increasing a temperature of the cooking liquid in the bottom circulation to a cooking temperature.

* * * * *